US010016771B2

(12) United States Patent
Zheng

(10) Patent No.: US 10,016,771 B2
(45) Date of Patent: Jul. 10, 2018

(54) DIAPHRAGM PUMP SPRAYER

(71) Applicant: Yuping Zheng, Shenzhen (CN)

(72) Inventor: Yuping Zheng, Shenzhen (CN)

( * ) Notice: Subject to any disclaimer, the term of this patent is extended or adjusted under 35 U.S.C. 154(b) by 0 days.

(21) Appl. No.: 15/237,814

(22) Filed: Aug. 16, 2016

(65) Prior Publication Data

US 2017/0197225 A1 Jul. 13, 2017

(30) Foreign Application Priority Data

Jan. 8, 2016 (CN) ..... 2016 1 0014070

(51) Int. Cl.

| | |
|---|---|
| ***B05B 9/04*** | (2006.01) |
| ***B05B 3/02*** | (2006.01) |
| ***F04B 43/02*** | (2006.01) |
| ***F04B 43/04*** | (2006.01) |
| ***B05B 15/33*** | (2018.01) |

(52) U.S. Cl.

CPC ..... *B05B 9/0426* (2013.01); *B05B 3/02* (2013.01); *B05B 9/0413* (2013.01); *B05B 15/33* (2018.02); *F04B 43/026* (2013.01); *F04B 43/04* (2013.01)

(58) Field of Classification Search

CPC ..... B05B 9/0426; B05B 9/0413; B05B 3/02; B05B 15/33; F04B 43/04; F04B 43/026

USPC ..... 222/464.4; 417/44.9, 112, 395, 413.1

See application file for complete search history.

(56) References Cited

U.S. PATENT DOCUMENTS 2,704,690 A * 3/1955 Eichenauer ..... B05B 9/0861 222/333
3,031,148 A * 4/1962 Holdren ..... B05B 1/14 134/166 R
3,580,430 A * 5/1971 Angele ..... B65D 83/32 222/394
3,768,732 A * 10/1973 Curtis ..... B05B 9/0861 222/333
3,901,449 A * 8/1975 Bochmann ..... B05B 9/0861 239/332
4,235,377 A * 11/1980 Davis ..... B05B 3/087 239/215
4,273,272 A * 6/1981 Blanc ..... B05B 11/0059 222/464.4
4,763,367 A * 8/1988 Henkin ..... A61H 33/027 239/416

(Continued)

*Primary Examiner* — Darren W Gorman

*Assistant Examiner* — Steven M Cernoch

(74) *Attorney, Agent, or Firm* — Hamre, Schumann, Mueller & Larson, P.C.

(57) ABSTRACT

The present invention is applicable to the fields of spraying and chemical agent instruments, and provides a diaphragm pump sprayer comprising a housing in which a battery, a motor and a hose are arranged, with one end of the hose being connected with a sinking water inlet ball and the other end being connected with a spray head, characterized in that: a diaphragm pump for water pumping is also arranged within the housing, one end of the diaphragm pump is connected with the hose and the other end is connected with the spray head, and the diaphragm pump is driven for water pumping by the battery and the motor. The diaphragm pump sprayer provided in the present invention realizes the purpose of pumping and spraying liquid by the diaphragm pump sprayer. The diaphragm pump, which has high chemical corrosion resistance and high working efficiency, is employed as a substitute for existing gear pumps, piston pumps and peristaltic pumps in the present invention.

10 Claims, 6 Drawing Sheets

(56) References Cited

U.S. PATENT DOCUMENTS 4,940,152 A * 7/1990 Lin ..... A61J 9/00 215/11.1
5,044,891 A * 9/1991 Ozawa ..... F04B 43/026 417/214
5,195,664 A * 3/1993 Rhea ..... B05B 11/0059 222/382
5,716,007 A * 2/1998 Nottingham ..... B05B 9/0861 222/333
5,785,245 A * 7/1998 Tedders, Jr. ..... B05B 7/0861 239/142
5,873,474 A * 2/1999 Gray ..... A61J 9/006 215/11.1
6,113,003 A * 9/2000 Condon ..... B05B 7/1422 222/226
6,283,139 B1 * 9/2001 Symonds ..... A01G 25/165 137/78.3
6,592,760 B2 * 7/2003 Dowdican ..... B04B 11/08 210/360.1
6,776,308 B1 * 8/2004 Davis ..... B01F 5/0077 137/266
7,451,900 B2 * 11/2008 Hornsby ..... B05B 1/34 222/325
8,118,241 B2 * 2/2012 Gardner ..... A47L 11/26 134/176
8,430,338 B2 * 4/2013 Duru ..... B05B 17/0623 239/102.2
8,545,195 B2 * 10/2013 Barton ..... H01M 8/0606 417/269
8,596,555 B2 * 12/2013 Thompson ..... B05B 9/01 239/152
2004/0056052 A1 * 3/2004 Verzino ..... B05B 11/0059 222/464.4
2005/0133540 A1 * 6/2005 Hornsby ..... B05B 15/006 222/333
2005/0133626 A1 * 6/2005 Hornsby ..... B05B 15/006 239/380
2008/0067263 A1 * 3/2008 Modlin ..... A01M 1/2038 239/70
2009/0200398 A1 * 8/2009 Duru ..... B05B 17/0623 239/102.2
2011/0198413 A1 * 8/2011 Thompson ..... B05B 9/01 239/322
2012/0006914 A1 * 1/2012 Badarinarayan ... F02M 37/0017 239/533.2
2013/0105598 A1 * 5/2013 Shultz ..... B05B 9/043 239/328
2013/0277455 A1 * 10/2013 Thompson ..... B05B 9/0416 239/289
2014/0158720 A1 * 6/2014 Lansky ..... B05B 11/0059 222/464.4

* cited by examiner

DIAPHRAGM PUMP SPRAYER

TECHNICAL FIELD

The present invention belongs to the fields of spraying and chemical agent instruments, and in particular relates to a diaphragm pump sprayer.

BACKGROUND ART

As is well known, in agricultural production, spraying pesticides is an extremely important procedure, because it is directly related to crop harvest. While due to the fact that the pesticides contain relatively high toxicity, people will typically use a spraying device to spray the pesticides on crops.

In daily life, spraying chemical agents for household disinfection care is also achieved by means of the spraying device. But the traditional spraying devices are mostly is a manual type, which are complicated in operation, excessively in long operation time, and can easily cause fatigue.

The spraying devices currently used are mainly a gear pump sprayer, a piston pump sprayer, a peristaltic pump sprayer, etc but these sprayers have the disadvantages as below (1) if the gear pump sprayer is used for pumping chemical fluids, obviously its service life cannot be secured because the chemical fluids are strong in corrosion, when the chemical fluids pass through the gear pump, it is easy to etch off or brush off the grease which playing the functions of sealing and lubricating in the gear pump, thereby causing the gear pump to stop working so that the service life is short, and additionally, the gear pump with low operation efficiency, is far away from meeting requirement of numerous fields.

(2) If the piston pump sprayer is used for pumping the chemical fluids, large friction force is produced as the piston and the pump inner chamber are well pressed, as a result, the operation efficiency is relatively low, energy consumption is relatively high, and it will produce lots of noises in operation, bring large difficulty in production and assembly as well as relatively high cost for use. Additionally, the pumped fluid (if the pumped fluid contains small particles) is easy to cause blocking between the piston and the pump chamber, largely reduces the operation efficiency of the pump body, and even breaks the whole pump.

(3) If the peristaltic pump sprayer is used to pump the chemical fluids, and because its operation principle is pumping the fluid into a spray head depending on a roller squeezing a hose, such that it is difficult to achieve a high pressure at the spray head to achieve an atomization effect. When the sprayer is provided a period of time without using, the hose will be deformed due to the squeezing of the roller, and even adhered together, thereby resulting in that the sprayer can't be normally used, making its service life largely reduced. If the roller's squeezing force is not enough, or the match between the wall side of the fixed hose and the roller is bad, its operation efficiency will be reduced to a great extent, and when the sprayer stops working, as the squeezing force is not enough, it cause the liquid backwash phenomenon. Additionally, this largely increases the difficulty of mass production, thereby resulting in a large amount of bad products, increasing its production cost.

SUMMARY OF THE INVENTION

The objectives of the present invention are to overcome the disadvantages of the foregoing prior art, provide a diaphragm pump sprayer which is chemical fluid corrosion preventable, anti-aging, highly efficient in operation and easy for mass production.

The present invention is achieved by a diaphragm pump sprayer, comprising a housing in which a battery, a motor and a hose are arranged, with one end of the hose being connected with a sinking water inlet ball, the other end being connected with a spray head, and a diaphragm pump used for water pumping is arranged within the housing, one end of the diaphragm pump being connected with the hose, the other end being connected with the spray head, the diaphragm pump being driven for water pumping by the battery and the motor.

Particularly, the diaphragm pump comprises a pump body and a pump cover mated with the pump body, a first chamber and a second chamber isolated from each other are arranged within the pump body, the first chamber and the second chamber are sealed by an elastic silicon sheet the elastic silicon sheet is injection-molded with a first push plate and a second push plate, and the first push plate and the second push plate are respectively driven by a first crank arranged on a first cam and a second crank arranged on a second cam.

The first chamber comprises a first water inlet and a first water outlet, the first water inlet is connected with the hose, the first water outlet is connected with the spray head, a first one-way water inlet valve is arranged at the first water inlet and can only introduce water in, and a first one-way water outlet valve is arranged at the first water outlet and can only discharge water.

The second chamber comprises a second water inlet and a second water outlet, the second water inlet is connected with the hose, the second water outlet is connected with the spray head, a second one-way water inlet valve is arranged at the second water inlet and can only introduce water in, and a second one-way water outlet valve is arranged at the second water outlet and can only discharge water.

More specifically, the first cam and the second cam are driven to rotate by the motor through a gear set.

The elastic piece is made of a corrosion-resistant and anti-ageing material or rubber material and is moulded together with a first push plate and a second push plate through injection moulding, so that in a return stroke of the push plates, the elastic piece enables the inner cavity of the pump body to produce a negative pressure due to the self-resilience force so as to realize a water absorbing function; in addition, the push plates can also give a pulling force to the elastic piece in the return stroke, so that the working efficiency of the diaphragm pump can be greatly improved.

The silica gel material has good corrosion resistance and anti-ageing property, thereby guaranteeing that the parts in contact with the liquid have long service life and are beneficial to wide application of the diaphragm pump sprayer in fields.

The hose is made of a silicon material, and the silicon material has good corrosion resistance and anti-ageing property, thereby guaranteeing that the parts in contact with the liquid have long service life and are beneficial to the wide application of the diaphragm pump sprayer in fields.

The spray head is rotatably arranged on the housing, different water spraying effects can be realized by rotating the spray head, to spray stream and fine mist.

The water inlet ball comprises a plastic casing and a ceramic ball arranged within the plastic casing, one end of the plastic casing is provided with a water inlet and the other end is connected with the hose. Both the plastic housing and the ceramic ball have good corrosion resistance and anti-ageing property, thereby guaranteeing that the parts in contact with the liquid have long service life and are beneficial to the wide application of the diaphragm pump sprayer in fields.

Further, the diaphragm pump sprayer further comprises a circuit protection switch for switching on or off a circuit, and the circuit protection switch is electrically connected with the motor.

Therefore, the adverse consequences caused by misoperation are prevented, and double guarantee is achieved.

When the diaphragm pump sprayer provided by the present invention is used, the motor is powered by the battery, the motor starts to rotate after being electrified, the motor drives the diaphragm pump to start to pump water, liquid enters into the hose through the water inlet ball, then enters the diaphragm pump through the hose and finally is sprayed out from the spray head, thus the diaphragm pump sprayer provided in the present invention realizes the purpose of pumping and spraying the liquid by the diaphragm pump sprayer. The diaphragm pump, which has high chemical corrosion resistance and high working efficiency, is employed as a substitute for existing gear pumps, piston pumps and peristaltic pumps in the present invention.

DETAILED DESCRIPTION OF THE INVENTION

In order to make the objectives, technical solution and advantages of the present invention become more apparent, the present invention will be described in further details hereafter accompanying the drawings and embodiments. It should be understood that the specific embodiments described herein are merely used to explain the present invention and are not intended to limit the present invention.

Figure 1:
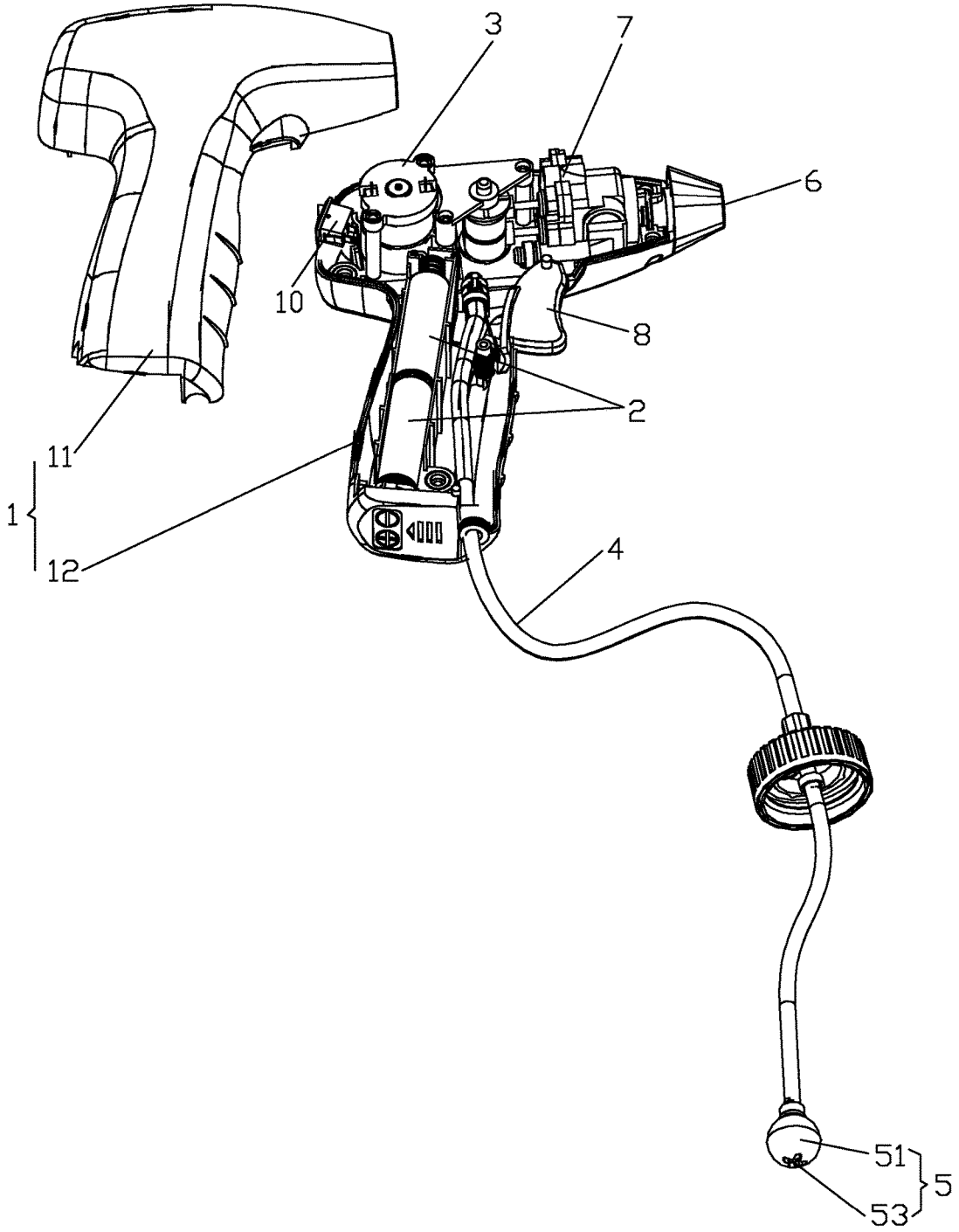
FIG. 1 is an exploded view of the diaphragm pump sprayer provided by the embodiment of the present invention.

As shown in FIG. 1, the diaphragm pump sprayer provided by the embodiment of the present invention comprises a housing 1 in which a battery 2, a motor 3 and a hose 4 are arranged, with one end of the hose 4 being connected with a sinking water inlet ball 5, the other end being connected with a spray head 6. A diaphragm pump 7 for water pumping is also arranged within the housing, one end of the diaphragm pump 7 being connected with the hose 4, the other end being connected with the spray head 6, the diaphragm pump 7 being driven for water pumping by the battery 2 and the motor 3. When the diaphragm pump sprayer is used, a switch 8 which is electrically connected with the battery 2 is pressed with a hand while a switch 10 is turned on, the motor 3 is powered by the battery 2, the motor 3 starts to rotate after being electrified, the motor 3 drives the diaphragm pump 7 to pump water, liquid enters into the hose 4 through the water inlet ball 5 and then enters the diaphragm pump 7 through the hose 4, and finally is sprayed out from the spray head 6, thus the diaphragm pump sprayer provided in the present invention realizes the purpose of pumping and spraying the liquid by the diaphragm pump sprayer. The diaphragm pump 7, which has high chemical corrosion resistance and high working efficiency, is employed as a substitute for existing gear pumps, piston pumps and peristaltic pumps in the present invention.

Various components of the present invention will be described in details hereinafter.

As shown in FIG. 1, the housing 1 is composed of an upper cover 11 of and a lower cover 12, the battery 2, the motor 3, the hose 4, the spray head 6, the diaphragm pump 7, and the switch 8 are all located in the lower cover 12, then the lower cover 12 and the upper cover 11 are mated, such that assembled to form a diaphragm pump sprayer.

Figure 2:
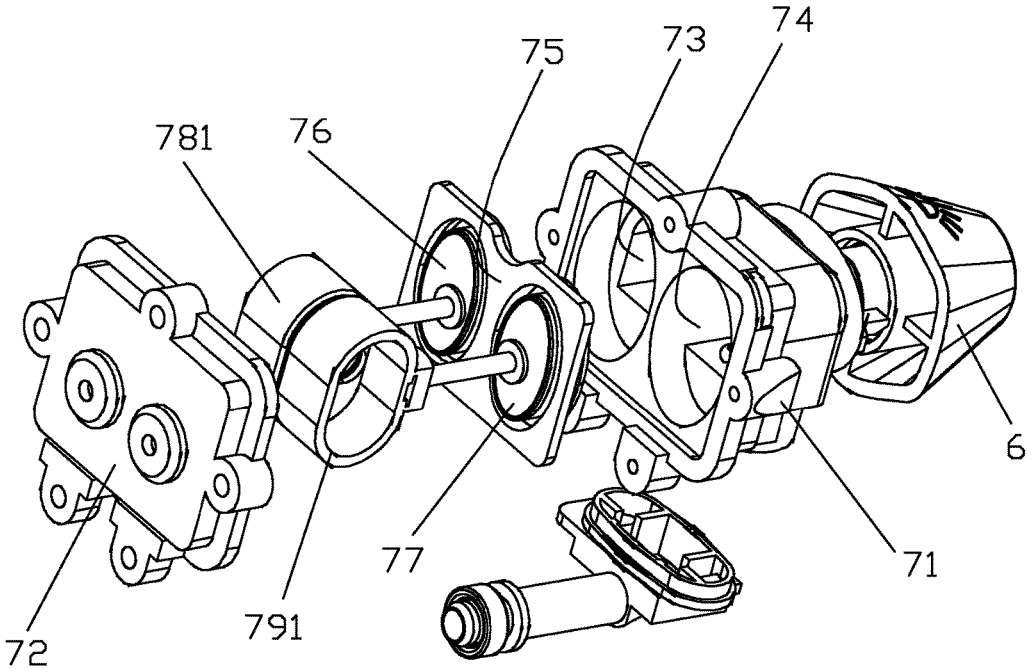
FIG. 2 is an exploded view of the diaphragm pump provided by the embodiment of the present invention.

As shown in FIG. 2, in particular, the diaphragm pump 7 comprises a pump body 71 and a pump cover 72 mated with the pump body 71, a first chamber 73 and a second chamber 74 isolated from each other are arranged within the pump body 71, the first chamber 73 and the second chamber 74 are sealed by an elastic piece 75, and the elastic piece 75 is disposed opposite to a first push plate 76 and a second push plate 77, and the first push plate 76 and the second push plate 77 are respectively driven by a first crank 781 arranged on a first cam 78 and a second crank 791 arranged on a second cam 79.

Figure 6:
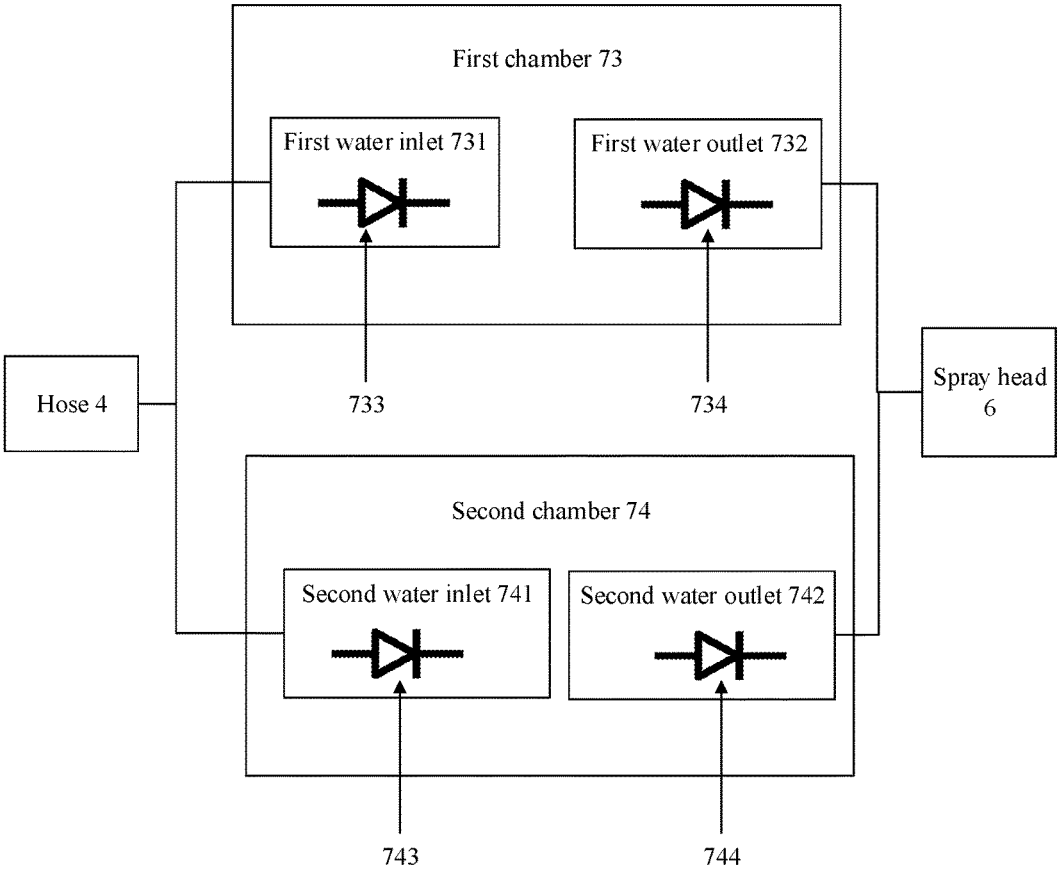
FIG. 6 is a schematic view of the chambers of the diaphragm pump connecting with the hose and the spray header provided by the embodiment of the present invention.

As shown in FIGS. 1, 2, and 6, more particularly, the first chamber 73 comprises a first water inlet 731 and a first water outlet 732, the first water inlet 731 is connected with the hose 4, the first water outlet 732 is connected with the spray head 6, a first one-way water inlet valve 733 is arranged at the first water inlet 731, a first one-way water outlet valve 734 being arranged at the first water outlet 732. The second chamber 74 comprises a second water inlet 741 and a second water outlet 742, the second water inlet 741 is connected with the hose 4, the second water outlet 742 is connected with the spray head 6, a second one-way water inlet valve 743 is arranged at the second water inlet 741, a second one-way water outlet valve 744 is arranged at the second water outlet 742.

Figure 3:
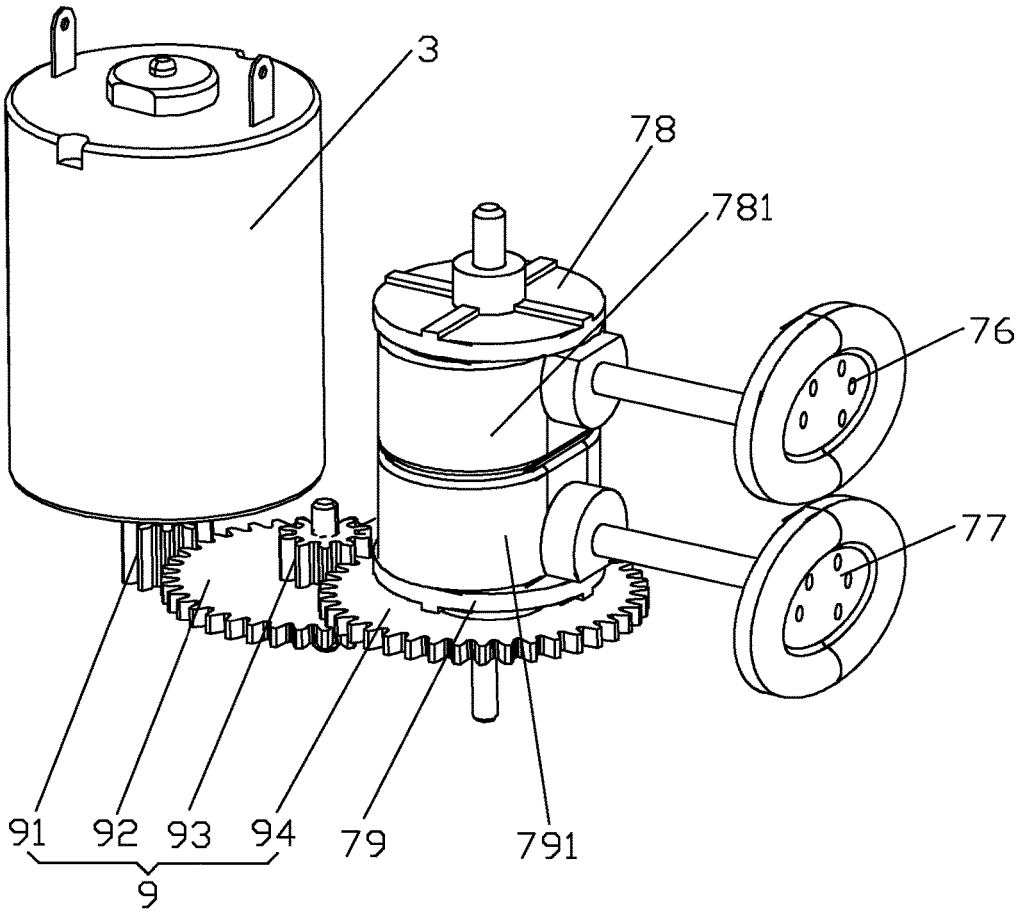
FIG. 3 is a schematic view for rotation of the first cam and the second cam driven by the motor through the gear set provided by the embodiment of the present invention.

As shown in FIG. 3, more specifically, the first cam 78 and the second cam 79 are driven to rotate through a gear set 9 by the motor 3, the specific connection of the gear set 9 being as follows: a rotation shaft of the motor 3 is fixedly provided with a pinion 91, the pinion 91 driving a gearwheel 92 engaged therewith to rotate, and another pinion 93 is coaxially mounted with the gearwheel 92, the pinion 93 driving another gearwheel 94 coaxially mounted with the first cam 78 to rotate, since the first cam 78 and the second cam 79 are connected together, so that the first cam 78 and the second cam 79 also rotate along with the gearwheel 94. The invention achieves rotation driving of the motor 3 on the first cam 78 and the second cam 79 by the gear set 9, the torque transmission is smooth, and the rotational speeds of the first cam 78 and the second cam 79 are also easy to control.

Preferably, the elastic piece 75 is made of a corrosion-resistant silicon material or rubber material, of course, also can be made of other corrosion-resistant materials, thus ensuring that the elastic piece 75 is not corrosive when the diaphragm pump 7 extracts corrosive liquid.

The specific pumping principle of the diaphragm pump 7 of the present invention is as follows:

(1) During the process of the motor 3 driving the first cam 78 and the second cam 79 through the gear set 9, when the first crank 781 drives the first push plate 76 to squeeze the elastic piece 75, the elastic piece 75 squeezes the first chamber 73, and the liquid in the first chamber 73 is discharged through the first water outlet and sprayed out from the spray head 6; meanwhile, the second crank 791 drives the second push plate 77 and the elastic piece 75 to leave the chamber 74, the elastic piece 75 recovers gradually from the original squeezed state until being pulled outwards by the second push plate 77, the volume of the second chamber 74 increases suddenly, the second chamber 74 forms a vacuum chamber, the external liquid successively passes through the water inlet ball 5, the hose 4 and the second water inlet to enter the second chamber 74 under the action of atmospheric pressure, thereby achieving the water pumping purpose of the diaphragm pump 7.

(2) Then, when the second crank 791 drives the second push plate 77 to squeeze the elastic piece 75, the elastic piece 75 squeezes the second chamber 74, and the liquid in the second chamber 74 is discharged through the second water outlet and sprayed out from the spray head 6; meanwhile, the first crank 781 drives the first push plate 76 and the elastic piece 75 to leave the chamber 73, the elastic piece 75 recovers gradually from the original squeezed state until being pulled outwards by the first push plate 76, the volume of the first chamber 73 increases suddenly, the first chamber 73 forms a vacuum chamber, the external liquid successively passes through the water inlet ball 5, the hose 4 and the first water inlet to enter the first chamber 73 under the action of atmospheric pressure, thereby achieving the water pumping purpose of the diaphragm pump 7.

(3) In general, during the process of the motor 3 driving the first cam 78 and the second cam 79 to rotate through the gear set 9, the first cam 78 and the second cam 79 make a relative motion, when the first cam drives the first crank 781 to drive the first push plate 76 to squeeze the elastic piece 75, while the first chamber 73 is squeezed to spray water, the second cam drives the second crank 791 to drive the second push plate 77 and the elastic piece 75 to leave the second chamber 74, resulting in the formation of the vacuum chamber to realize the water pumping effect; and consequently, the diaphragm pump achieves a two-way function, namely, both a water-pumping function and a water-spray function are achieved in each working stroke, thereby greatly improving the work efficiency. The novel design of the two-way diaphragm pump represents how the invention effectively provides the work efficiency of the sprayer, thus being superior to other existing pumps.

As the diaphragm pump sprayer of the present invention is mainly used for extracting and spraying chemical agents and these chemical agents are usually corrosive, in order to avoid the phenomenon that the hose 4 is bonded due to the corrosion of the chemical agents, the hose 4 is made of the silicon material capable of resisting chemical corrosion.

As shown in FIG. 1, the spray head 6 is rotatably arranged on the housing 1, so that the chemical agents are sprayed out in the form of mist or water column, and the sprayed chemical agents are large in cover area and good in spraying effect.

Figure 4:
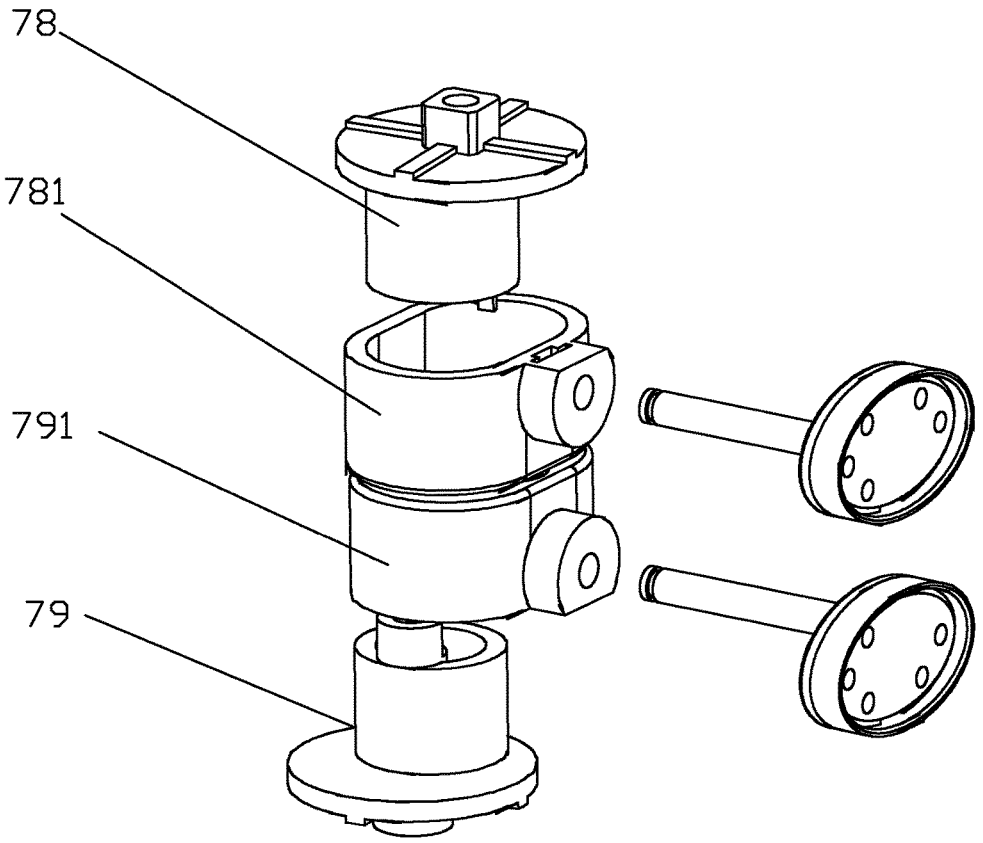
FIG. 4 is an exploded view of the first cam and the second cam as well as the first push plate and the second push plate provided by the embodiment of the present invention.
Figure 5:
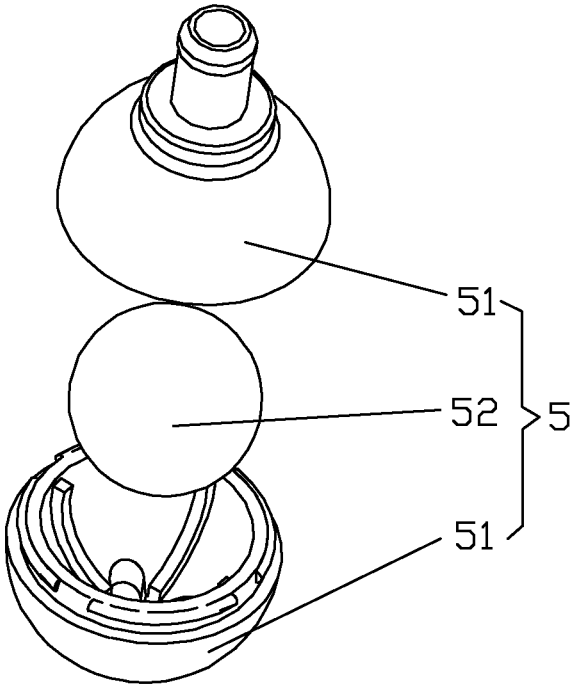
FIG. 5 is an exploded view of the water inlet ball provided by the embodiment of the present invention.

As shown in FIGS. 1 and 4, the water inlet ball 5 comprises a plastic casing 51 and a ceramic ball 52 arranged within the plastic casing 51, one end of the plastic casing 51 is provided with a water inlet 53, and the other end is connected with the hose 4. The ceramic ball 52 is arranged within the plastic casing 51, since the ceramic ball 52 has a certain weight, the water inlet ball 5 can be completely soaked in the liquid, thereby ensuring that the diaphragm pump sprayer extracts the liquid normally.

As shown in FIG. 1, further, the diaphragm pump sprayer of the present invention also comprises a circuit protection switch 10, the circuit protection switch 10 is electrically connected with the motor 3, and the circuit protection switch 10 is used for switching on or switching off a circuit, thereby achieving the effect of well controlling the diaphragm pump sprayer and preventing the adverse consequences caused by misoperation.

The foregoing descriptions are only preferable embodiments of the present invention and are not used for limiting the present invention. Various modifications, equivalent substitutions and improvements which are made without departing from the spirit and principles of the present invention shall fall within the protective scope of the present invention.

The invention claimed is:

1. A diaphragm pump sprayer, comprising:

a housing in which a battery, a motor and a hose are arranged, with one end of the hose being connected with a sinking water inlet ball and the other end being connected with a spray head, the sinking water inlet ball being located outside of the housing, wherein a diaphragm pump for water pumping is also arranged within the housing, one end of the diaphragm pump is connected with the hose and the other end is connected with the spray head, the diaphragm pump comprises a pump body and a pump cover mated with the pump body, a first chamber and a second chamber isolated from each other are arranged within the pump body, the first chamber and the second chamber are configured so that when the first chamber is squeezed to spray water into the spray head, water is pumped from the hose into the second chamber, and when the second chamber is squeezed to spray water into the spray head, water is pumped from the hose into the first chamber.

2. The diaphragm pump sprayer of claim 1, wherein the first chamber and the second chamber are sealed by an elastic piece, the elastic piece is injection-molded with a first push plate and a second push plate, the first push plate and the second push plate are respectively driven by a first crank arranged on a first cam and a second crank arranged on a second cam, and the first chamber and the second chamber are sandwiched between the elastic piece and the spray head.

3. The diaphragm pump sprayer of claim 2, wherein the first chamber comprises a first water inlet and a first water outlet, the first water inlet is connected with the hose, the first water outlet is connected with the spray head, a first one-way water inlet valve is arranged at the first water inlet, and a first one-way water outlet valve is arranged at the first water outlet.

4. The diaphragm pump sprayer of claim 2, wherein the second chamber comprises a second water inlet and a second water outlet, the second water inlet is connected with the hose, the second water outlet is connected with the spray head, a second one-way water inlet valve is arranged at the second water inlet, and a second one-way water outlet valve is arranged at the second water outlet.

5. The diaphragm pump sprayer of claim 2, wherein the first cam and the second cam are driven to rotate by the motor though a gear set.

6. The diaphragm pump sprayer of claim 2, wherein the elastic piece is an elastic piece made of a corrosion-resistant and anti-aging silicon material or rubber material.

7. The diaphragm pump sprayer of claim 1, wherein the hose is made of a silicon material.

8. The diaphragm pump sprayer of claim 1, wherein the spray head is rotatably arranged on the housing.

9. The diaphragm pump sprayer of claim 1, wherein the water inlet ball comprises a plastic casing and a ceramic ball arranged within the plastic casing, one end of the plastic casing is provided with a water inlet and the other end is connected with the hose.

10. The diaphragm pump sprayer of claim 1, further comprising: a circuit protection switch for switching on or off a circuit, the circuit protection switch being electrically connected with the motor.

* * * * *